US006000064A

United States Patent [19]

Alcone et al.

[11] Patent Number: 6,000,064

[45] Date of Patent: Dec. 14, 1999

[54] GARMENT POCKET SUPPORT MEANS

[75] Inventors: Jerry M. Alcone, 1423 Tomases Dr., Albuquerque, N.Mex. 87102; Iris Faye Redfern, Lakewood, Calif.

[73] Assignee: Jerry M. Alcone, Albuquerque, N.Mex.

[21] Appl. No.: 09/072,659

[22] Filed: May 5, 1998

[51] Int. Cl.[6] ..... A41D 27/20

[52] U.S. Cl. ..... 2/248; 2/247; 2/122

[58] Field of Search ..... 2/113, 115, 118, 2/120, 122, 247, 248, 255, 250, 251, 92, 103, 468, 463, 300

[56] References Cited

U.S. PATENT DOCUMENTS

| | | | |
|---|---|---|---|
| D. 269,221 | 6/1983 | Portwood et al. . | |
| D. 373,673 | 9/1996 | Colling . | |
| 1,203,057 | 10/1916 | Schroeder . | |
| 1,488,539 | 4/1924 | Harsh . | |
| 1,489,080 | 3/1924 | Lee | 2/122 |
| 1,504,114 | 12/1924 | Flora | 2/122 |
| 1,578,969 | 3/1926 | Feiss . | |
| 1,599,687 | 9/1926 | Sullivan . | |
| 2,240,902 | 5/1941 | Fishman . | |
| 2,601,046 | 6/1952 | McDonald . | |
| 2,688,752 | 9/1954 | Sbarra et al. . | |
| 2,690,564 | 10/1954 | Kingston et al. . | |
| 4,171,542 | 10/1979 | Cox et al. . | |
| 4,510,626 | 4/1985 | Bowditch . | |
| 4,813,081 | 3/1989 | Cliff . | |
| 5,075,900 | 12/1991 | Chittenden . | |
| 5,075,901 | 12/1991 | Vollrath . | |
| 5,094,648 | 3/1992 | Turner . | |
| 5,175,888 | 1/1993 | Clark . | |
| 5,758,363 | 6/1998 | Winfree | 2/122 |

*Primary Examiner*—Michael A. Neas
*Assistant Examiner*—Tejash D Patel
*Attorney, Agent, or Firm*—Bernhard Kreten

[57] ABSTRACT

A garment pocket reinforcement including a trapezoidally shaped insert having a bottom edge, a substantially straight side edge, a sloped side edge, a first shoulder edge, a second shoulder edge and a semi circular transitional edge. The first shoulder edge and the second shoulder edge of the insert are respectively sewn to a right shoulder seam and a left shoulder seam of a shirt. The bottom edge of the insert is sewn to the back side of a pocket disposed on the shirt. The insert further includes a transitional band of material which is used to attach the semi-circular transitional edge of the insert to a collar of the shirt along the front half of the neck line. The shoulders of the shirt also include small arches which are taking up on both front and back sides of both the right and left shoulder seems.

17 Claims, 2 Drawing Sheets

GARMENT POCKET SUPPORT MEANS

FIELD OF THE INVENTION

The following invention relates generally to garments. More specifically, the following invention is directed to a garment reinforcement means, in particular, support means for a shirt pocket.

BACKGROUND OF THE INVENTION

Various garment improvements have been accomplished over the years since garments were first conceived. One improvement was to add a pocket to the front chest area of a shirt to, inter alia, provide a means for carrying various articles. However, one problem frequently encountered by some is that the load on the pocket may cause the pocket to stretch outwardly and downwardly and likewise cause pulling or tension upon the top of the shirt thereby distorting the neck line. This is an especially prevalent problem to those persons who carry a plurality of writing implements or other such weighty items in that front shirt pocket. In the past, as the amount of weight increased within and upon such a shirt pocket, so did the amount of distress on the pocket and the shirt as a whole increase.

The following prior art reflects the state of the art of which applicants are aware and is included herewith to discharge applicants' acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | ISSUE DATE | PATENT NO. |
|---|---|---|
| Schroeder | October 31, 1916 | 1,203,057 |
| Harsh | April 1, 1924 | 1,488,539 |
| Feiss | March 30, 1926 | 1,578,969 |
| Sullivan | September 14, 1926 | 1,599,687 |
| Fishman | May 6, 1941 | 2,240,902 |
| McDonald | June 17, 1952 | 2,601,046 |
| Sbarra, et al. | September 14, 1954 | 2,688,752 |
| Kingston, et al. | October 5, 1954 | 2,690,564 |
| Cox, et al. | October 23, 1979 | 4,171,542 |
| Portwood, et al. | June 7, 1983 | Des. 269,221 |
| Bowditch | April 16, 1985 | 4,510,626 |
| Cliff | March 21, 1989 | 4,813,081 |
| Chittenden | December 31, 1991 | 5,075,900 |
| Vollrath | December 31, 1991 | 5,075,901 |
| Turner | March 10, 1992 | 5,094,648 |
| Clark | January 5, 1993 | 5,175,888 |
| Colling | September 17, 1996 | Des. 373,673 |

SUMMARY OF THE INVENTION

The present invention is distinguished over the known prior art in a multiplicity of ways. For one thing, the present invention provides a shirt pocket aid in the form of a support or reinforcement means coupled to a back side of a shirt pocket and the shirt as herein described. In addition, the reinforcement means according to the present invention preferably includes a multi-sided, non-stretchable material coupled to the inside of such a shirt to act as an aid or support.

In a preferred form, the insert is coupled preferably by sewing means to the inside shoulder seams of the shirt, the backside of the pocket at about a point one-third of the way down the pocket, or alternatively to the side seams of the upper third of the pocket, and coupled also by sewing means at the neckline to a semi-circular transition band, which itself is attached to the collar and is made of a material not unlike that of the underlying shirt. By coupling the insert in such a manner, load from the pocket may be transferred upwardly toward the shoulders, as opposed to merely at and upon the pocket itself. The non-stretch material must, of course, be a material that is comfortable to any potential skin exposure of a wearer. Therefore, sufficient softness and breathability must be insured.

OBJECTS OF THE INVENTION

Accordingly, a primary object of the present invention to provide a useful and novel shirt pocket support means.

A further object of the present invention to prevent the unsightly sagging and distortion of a shirt or shirt pocket weighted by foreign objects.

Another further object of the present invention to provide enhanced utility of a shirt pocket, especially to those users who may avoid using such pockets due to the fear of unsightly distortion.

Another further object of the present invention is to cause the neckline of such a shirt to stay in place as opposed to distorting downwardly or sagging.

Another further object of the present invention is to provide such reinforcement means in a way such that the insert is hidden from view.

Another further object of the present invention is to provide such a device in a manner that is comfortable to the wearer of such a garment by retaining its flexibility.

Another object of the present invention to provide an insert such as will be described herein that may be retrofitted to existing shirts or manufactured with and into new shirts.

Viewed from a first vantage point, it is an object of the present invention to provide a garment, comprising in combination, a pocket operatively coupled to the garment and defining a blind bore for carrying various articles, a pocket support means including a first side operatively coupled to the pocket and upwardly extending from the pocket to a second and third side, the second and third side respectively coupled to left and right shoulder seams of the garment, wherein the support means precludes pocket distention when the pocket is carrying load bearing articles.

Viewed from a second vantage point, it is an object of the present invention to provide a garment pocket reinforcement means, comprising in combination, a multi-sided insert having a bottom edge transitioning into a pair of spaced apart top edges, the bottom edge attached to a back side of a pocket disposed on a shirt, and each top edge attached to shoulder seam areas of the shirt, wherein the insert precludes distention of the shirt and pocket when weighted objects are carried therein.

Viewed from a third vantage point, it is an object of the present invention to provide a method for reinforcing a pocket disposed on a garment, the steps including, forming a multi-sided material insert having a bottom edge, a substantially straight side edge, a sloped side edge, a first shoulder edge, a second shoulder edge and a semi-circular transition band interposed between the first shoulder edge and the second shoulder edge, attaching the bottom edge to a back side of the pocket disposed on the shirt, and attaching the first shoulder edge to a first shoulder seam of the shirt and attaching the second shoulder edge to a second shoulder seam of the shirt.

DESCRIPTION OF PREFERRED EMBODIMENTS

Figure 1:
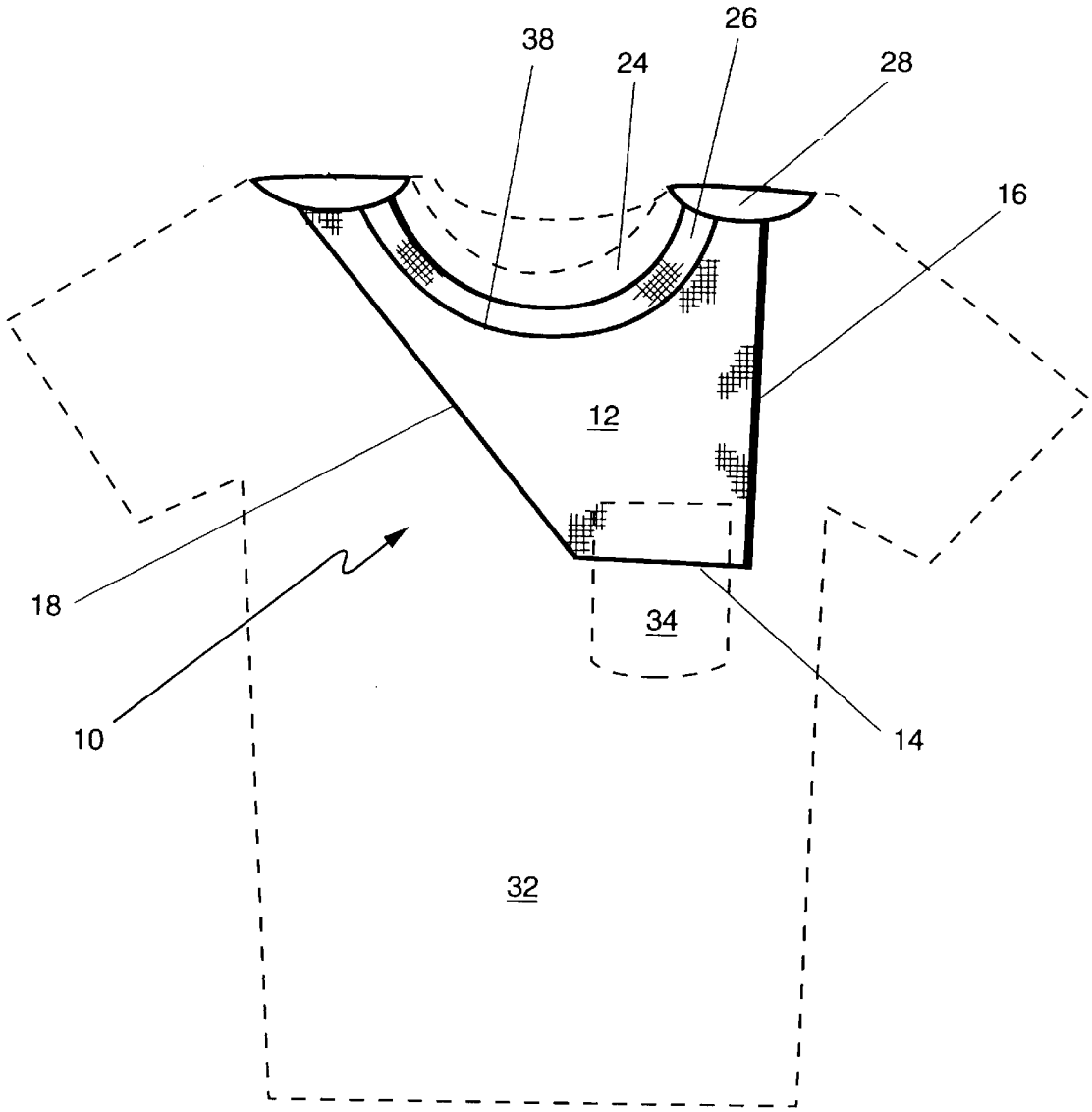
FIG. 1 is a front view of a shirt and pocket in phantom with the invention depicted thereunder.

Considering the drawings, wherein like reference numerals denote like parts throughout the various drawing figures, reference numeral 10 is directed to the shirt pocket support according to one form of the present invention.

In its essence and referring to FIG. 1, the shirt pocket support or reinforcement 10 includes a multi-sided insert 12, a collar transition strip 26, and shoulder junctures 28, 30.

Figure 3:
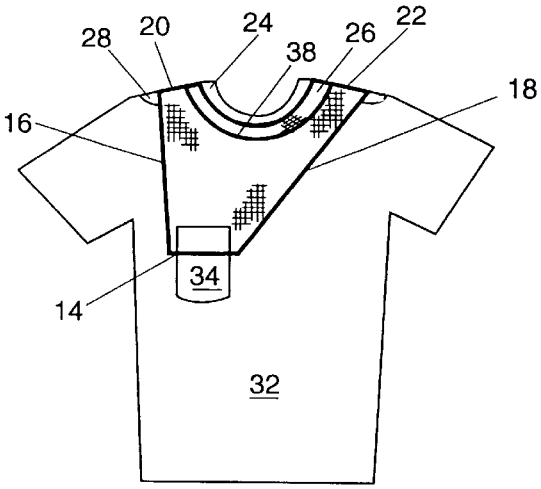
FIG. 3 is a front view of an inside-out shirt depicting the present invention.

More particularly, and referring to FIGS. 1 and 3, the insert 12 is preferably substantially trapezoidally shaped and includes a bottom edge 14, a substantially straight side edge 16, a sloped side edge 18, a first (left) shoulder edge 20, a second (right) shoulder edge 22, and a collar transition edge 38. Of course, the angle or slope of the side edges 16, 18, are dependent upon the location of the pocket 34 on the shirt 32. As depicted, side edge 16 is substantially straight. However, if pocket 34 were placed elsewhere on shirt 32, side edge 16 would be sloped. Insert 12 may be of any material that will provide reinforcement capabilities to the pocket, however, it is preferred that a non-stretchable material, relative to the shirt material elasticity, is utilized for this purpose. It is also preferred that the material, though it be non-stretchable, also be comfortable to a wearer's skin.

Figure 2:
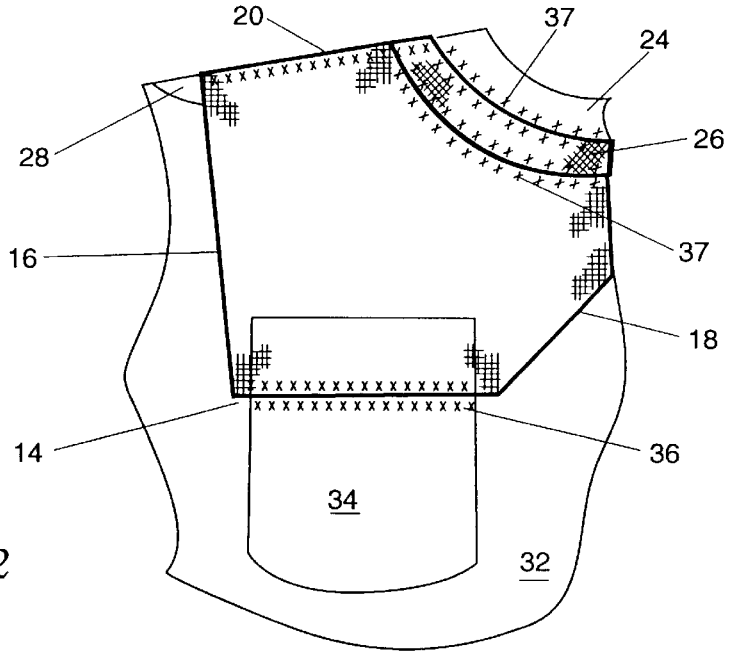
FIG. 2 is a front view of an inside-out shirt cutaway to depict in detail the insert on the shirt.

Referring to FIG. 2, the bottom edge 14 of the insert 12 is coupled to a pocket 34 on shirt 32. Preferably, the bottom edge 14 is coupled to the pocket 34 on shirt 32 approximately one-third of the way down pocket 34. Coupling is preferably accomplished by readily available stitching or sewing means 36. Referring to FIG. 3, the left shoulder edge 20 and right shoulder edge 22 are likewise coupled to the shoulder seams of the shirt 32. The shoulder edges 20, 22 are approximately two inches in length.

Figure 4:
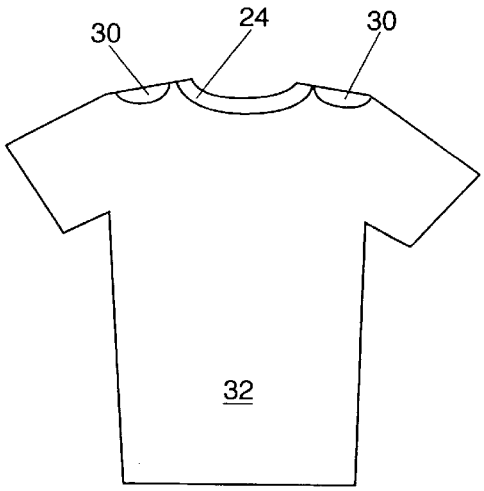
FIG. 4 is the back of an inside-out shirt depicting the present invention.
Figure 5:
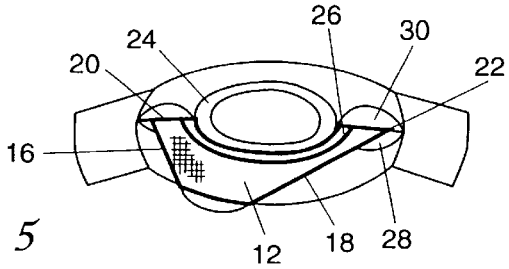
FIG. 5 is a top view of an inside-out shirt depicting the present invention.

Referring to FIGS. 4 and 5, the shoulders also include small arcs which are preferably about one-half inch in height and are taken up on the front and/or back side of both the right and left shoulder seams. By "taken up", it is meant that material is eliminated. That is, the shirt is tightened on the front side at the shoulders. This offsets the additional loading that is transferred to the shoulders by the trapezoidally shaped support. The small arcs are comprised of a front shoulder juncture 28 and/or a back shoulder juncture 30 (please see FIG. 5).

Referring to FIGS. 1 and 2, the pocket reinforcement means 10 includes a collar transition strip or band 26 wherein the band 26 is preferably one to two inches in width and made of a material comparable with the neck material of the shirt 32. The band 26 is coupled, preferably by stitching 37, to the shirt collar 24 on one edge and to the insert 12 on an opposite edge. This band is arcuate in shape and connects only to the front of the shirt collar. The non-stretchable material mentioned hereinabove is preferably an open or mesh weave and optionally may be reinforced with tapes of closer weave or non-stretchable material along the sides of the trapezoidally shaped insert 12 or edges 16 and 18.

As will now be evident to those having ordinary skill in the art, informed by the present disclosure, adding weighted objects to the pocket 34 of a shirt 32 having the invention 10 included thereon will cause force to transfer from the pocket upward to the uppermost portion of the shirt, thereby distributing the force load evenly thereabove. By distributing the load in such a manner, undesired distortion or sagging is minimized if not wholly eliminated. Therefore, a wearer of a garment having the invention 10 included thereon may load the pocket 34 at will with pens, pencils, notebooks, or other such useful items without fear of sagging, distortion, or other such undesired results.

In use and operation, and referring to the drawings, the shirt pocket support 10 includes the multi-sided insert 12 which is formed from a non-stretch material which is comfortable to a wearer's sense of touch. The insert is preferable trapezoidally shaped and includes bottom edge 14 which is sewn to the back side of the pocket 34 of, for example, a T-shirt 32. The insert 12 further includes the first shoulder edge 20 and the second shoulder edge 22 which are separated from the bottom edge by the substantially straight side edge 16 and the sloped side edge 18 respectively. The first and second shoulder edges are separated from one another via collar transition edge 38. Preferably, the first shown shoulder edge 20 is sewn to a left seam of the T-shirt and the second shoulder edge 22 is shown sewn to the right seam of the T-shirt. The collar transition edge 38 is coupled to the shirt collar 24 via the collar transition strip or band 26 which is stitched to the insert 12 at the collar transition edge 38 and to the shirt collar 24. Preferably the band 26 is arcuate in shape and follows the activity of the collar 24. The transition strip 26 is preferably formed from a stretchable material as is typically used to form the T-shirt collar. The stretchable transition strip 26 interposed between the insert 12 and the neck of the T-shirt precludes any inadvertent entanglement by portions of the wearer's body when donning the T-shirt. Furthermore, the transition band 26 gives added support to the insert 12.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A garment, comprising in combination:

a pocket operatively coupled to the garment and defining a blind bore for carrying various articles;

a pocket support means defined by an underlying insert attached to a shirt interior including a first side operatively coupled to said pocket and upwardly extending from said pocket to a second and third side;

said second and third side respectively coupled to left and right shoulder seams of the garment;

wherein said support means precludes pocket distention when the pocket is carrying load bearing articles.

2. The garment of claim 1 further including an arcuate collar transition strip coupled to a shirt collar of the garment.

3. A garment pocket reinforcement kit fastened to an interior of a shirt adjacent a shirt pocket, comprising in, combination:

a multi-sided insert having a bottom edge transitioning into a pair of spaced apart top edges, said insert attached to the shirt interior;

said bottom edge attached to a back side of the pocket disposed on the shirt, and each said top edge attached to shoulder seam areas of the shirt;

wherein said insert precludes distention of the shirt and pocket when weighted object are carried therein.

4. The garment pocket reinforcement kit of claim 3 further including a collar transition strip which is coupled to said insert and interposed between said pair of spaced apart top edges.

5. The garment pocket reinforcement kit of claim 4 wherein said collar transition strip is attached to a collar of the shirt.

6. The garment pocket reinforcement kit of claim 5 wherein said insert is substantially trapezoidally shaped.

7. The garment pocket reinforcement kit of claim 6 wherein said trapezoidally shaped insert includes a substantially straight side edge transitioning from a first outer end of said bottom edge to an outer end of one said top edge.

8. The garment pocket reinforcement kit of claim 7 wherein said trapezoidally shaped insert further includes a sloped side edge transitioning from a second outer end of said bottom edge to an outer end of the other said top edge.

9. The garment pocket reinforcement kit of claim 8 wherein said collar transition strip is arcuate in shape and attaches only to a front of the shirt collar.

10. The garment pocket reinforcement kit of claim 9 wherein said insert is formed from non-stretchable material.

11. The garment pocket reinforcement kit of claim 10 wherein said collar transition strip is formed from a stretchable material.

12. A method for reinforcing a pocket disposed on a garment, the steps including:

forming a multi-sided material insert having a bottom edge, a substantially straight side edge, a sloped side edge, a first shoulder edge, a second shoulder edge and a semi-circular transition band interposed between the first shoulder edge and the second shoulder edge;

attaching the bottom edge to a back side of the pocket disposed on the shirt; and attaching the first shoulder edge to a first shoulder seam of the shirt and attaching the second shoulder edge to a second shoulder seam of the shirt.

13. The method of claim 12 further comprising the step of attaching the semi-circular transition band to a lower most area of a collar of the shirt.

14. The method of claim 12 further comprising the step of tightening the shirt at the shoulders by taking up small arc areas on both the front and back sides of the shirt proximate the right and left shoulder seams wherein pocket loading is transferred to the shoulders by the multi-sided insert and wherein force promulgated by weighted objects carried by the pocket is distributed upward to the uppermost portion of the shirt thereby precluding shirt and pocket distortion and sagging.

15. A garment, comprising, in combination:

a pocket operatively coupled to the garment and defining a blind bore for carrying various articles;

a pocket support means including a first side operatively coupled to said pocket and upwardly extending from said pocket to a second and third side;

said second and third side respectively coupled to left and right shoulder seams of the garment;

wherein said support means precludes pocket distention when the pocket is carrying load bearing articles; and further including an arcuate collar transition strip coupled to a shirt collar of the garment.

16. A garment pocket reinforcement kit, comprising, in combination:

a multi-sided insert having a bottom edge transitioning into a pair of spaced apart top edges;

said bottom edge attached to a back side of a pocket disposed on a shirt, and each said top edge attached to shoulder seam areas of the shirt;

wherein said insert precludes distention of the shirt and pocket when weighted objects are carried therein; and further including a collar transition strip which is coupled to said insert and interposed between said pair of spaced apart top edges.

17. A shirt which garbs an upper torso of a wearer comprising, in combination:

a pocket; a reinforcer for the pocket; said reinforcer comprising, non-stretchable load distribution means extending from a back face of the shirt pocket toward shoulder areas of the shirt and attached to an interior of the shirt, thwarting distention of the pocket under load by load distribution.

* * * * *